US005704299A

United States Patent [19]

Corpuz, Jr. et al.

[11] Patent Number: 5,704,299

[45] Date of Patent: Jan. 6, 1998

[54] KEYBOARD SUPPORT

[75] Inventors: Roque Matias Corpuz, Jr., Grand Rapids; Brian D. T. Alexander, Fennville, both of Mich.

[73] Assignee: Haworth, Inc., Holland, Mich.

[21] Appl. No.: 649,032

[22] Filed: May 16, 1996

Related U.S. Application Data

[63] Continuation-in-part of Ser. No. 52,784, Apr. 5, 1996.

[51] Int. Cl.[6] ..... A47B 35/00

[52] U.S. Cl. ..... 108/50; 108/147; 108/64

[58] Field of Search ..... 108/145, 147, 108/50, 2, 3, 6, 7, 9, 10; 312/195, 194, 223.3, 223.1, 223.2; 248/917–923

[56] References Cited

U.S. PATENT DOCUMENTS

| | | | |
|---|---|---|---|
| D. 288,097 | 2/1987 | Harter et al. . | |
| 2,356,924 | 8/1944 | Froelich . | |
| 2,545,515 | 3/1951 | Gannett et al. . | |
| 3,213,809 | 10/1965 | Kritske . | |
| 3,703,147 | 11/1972 | Selander . | |
| 3,710,735 | 1/1973 | Litvinoff et al. . | |
| 4,278,032 | 7/1981 | Kritske . | |
| 4,365,561 | 12/1982 | Tellier et al. . | |
| 4,381,714 | 5/1983 | Henneberg et al. . | |
| 4,383,486 | 5/1983 | Reineman et al. . | |
| 4,515,086 | 5/1985 | Kwiecinski et al. . | |
| 4,616,798 | 10/1986 | Smeenge et al. . | |
| 4,625,657 | 12/1986 | Little et al. . | |
| 4,637,322 | 1/1987 | Hampshire et al. . | |
| 4,646,655 | 3/1987 | Robolin . | |
| 4,688,862 | 8/1987 | Fowler et al. . | |
| 4,691,886 | 9/1987 | Wendling et al. . | |
| 4,691,888 | 9/1987 | Cotterill . | |
| 4,725,106 | 2/1988 | Shields et al. | 108/3 X |
| 4,779,922 | 10/1988 | Cooper . | |
| 4,852,500 | 8/1989 | Ryburg et al. . | |
| 4,863,124 | 9/1989 | Ball et al. . | |
| 4,976,407 | 12/1990 | Schwartz et al. . | |
| 5,033,804 | 7/1991 | Faris . | |
| 5,041,770 | 8/1991 | Seiler et al. . | |
| 5,044,284 | 9/1991 | Gross . | |
| 5,071,204 | 12/1991 | Price et al. . | |
| 5,088,420 | 2/1992 | Russell . | |
| 5,094,514 | 3/1992 | Grosch . | |
| 5,118,172 | 6/1992 | Ugalde . | |
| 5,120,117 | 6/1992 | Williams . | |
| 5,161,760 | 11/1992 | Terbrack . | |
| 5,174,223 | 12/1992 | Nagy et al. . | |
| 5,273,250 | 12/1993 | Pemberton et al. . | |
| 5,287,815 | 2/1994 | Gross . | |
| 5,311,827 | 5/1994 | Greene . | |
| 5,322,025 | 6/1994 | Sherman et al. . | |
| 5,398,622 | 3/1995 | Lubinskas et al. . | |
| 5,405,204 | 4/1995 | Ambrose . | |
| 5,483,898 | 1/1996 | Seidl | 108/3 |
| 5,522,323 | 6/1996 | Richard . | |
| 5,533,820 | 7/1996 | Ambrose . | |
| 5,567,067 | 10/1996 | Ambrose . | |

OTHER PUBLICATIONS

*Architectural Record*, "Teamwork Kit–of–Parts", May 1995 (1 page).

*Interiors*, "Products Introduction", May 1995 (2 pages).

*Facilities Design & Management*, "Hotline", May 1995 (2 pages).

*Contract Design*, "The Future Arrives–in 1995?", May 1995 (1 page).

*Primary Examiner*—Jose V. Chen

*Attorney, Agent, or Firm*—Flynn, Thiel, Boutell & Tanis, P.C.

[57] ABSTRACT

A keyboard support stand having a height-adjustable support frame and a keyboard support tray and arm rest which are carried by the support frame and are independently adjustable. The keyboard tray is pivotally mounted so as to be adjustable through a significant angular range between a raised position above a horizontal plane and a lowered position angling downwardly. The arm rest which supports the forearms of a user is similarly angularly adjustable through a similar angular range between raised and lowered positions. Any combination of angular positions of the arm rest and keyboard tray, as well as the height thereof, can be provided so as to optimize the comfort of the user.

24 Claims, 12 Drawing Sheets

KEYBOARD SUPPORT

CROSS-REFERENCE TO RELATED APPLICATION

This is a continuation-in-part of copending U.S. Design patent application Ser. No. 29/052784, filed Apr. 5, 1996, the disclosure of which is incorporated herein by reference in its entirety.

FIELD OF THE INVENTION

This invention relates to a keyboard support or stand and, more particularly, to a height-adjustable keyboard support having a relatively adjustable arm rest, keyboard support tray, and monitor support tray.

BACKGROUND OF THE INVENTION

Computers are used extensively in offices and businesses, which computers include a monitor (commonly referred to as a CRT), a keyboard and a central processing unit (commonly referred to as a CPU). Computers are readily accommodated in workstation areas typically formed by systems furniture and, in particular, by wall panels that define distinct workstation areas. Numerous independent computer support stands or tables have also been provided. However, a need still exists for a computer workstation which is readily movable and is highly adjustable to accommodate the many and varied unique needs and characteristics of different users.

An example of a movable computer support stand is disclosed in U.S. Pat. No. 5,322,025. This patent discloses a stand which includes one worksurface for supporting a keyboard and an additional worksurface for supporting the CPU and monitor. Such arrangement, however, does not provide the desired degrees of flexibility and adjustability including an arm rest and keyboard stand which are independently adjustable.

To provide increased flexibility in creating a workstation area which might be used temporarily and then moved or stored away, it is an object of this invention to provide a readily movable keyboard stand for supporting a keyboard. Additionally, due to the different characteristics of each user, it is a further object of the invention to provide a keyboard stand having multiple worksurfaces which are readily height-adjustable. Additionally, it is an object to provide a tray for supporting the keyboard, which keyboard tray is pivotable to adjust the angular orientation thereof and provide increased comfort for the user. To further support the forearms of the user and optimize comfort, it also is an object to provide an angularly adjustable armrest.

The invention relates therefore to a height-adjustable keyboard support stand which is readily movable from one location to another by simply raising a front end thereof and moving the keyboard stand by way of casters provided on the bottom thereof. Additionally, to accommodate the varying needs of a user, the worksurfaces of the keyboard stand are height-adjustable so as to readily accommodate a variety of users.

The keyboard support stand also includes a keyboard tray which receives a keyboard and is pivotally mounted so as to be adjustable through an angular range of approximately 35 degrees between a raised position above a horizontal plane and a lowered position angling downwardly below the horizontal plane. Similarly, an independently movable arm rest is provided to support the forearms of a user, which arm rest is angularly adjustable through a path of approximately 45 degrees between a raised position and a lowered position. Thus, a wide range of angular positions of the arm rest and keyboard tray can be provided so as to optimize the comfort of the user, which comfort is further enhanced by the ability to adjust the height of the keyboard stand itself.

Other objects and purposes of the invention will be apparent to persons familiar with structures of this general type upon reading the following specification and inspecting the accompanying drawings.

Figure 1:
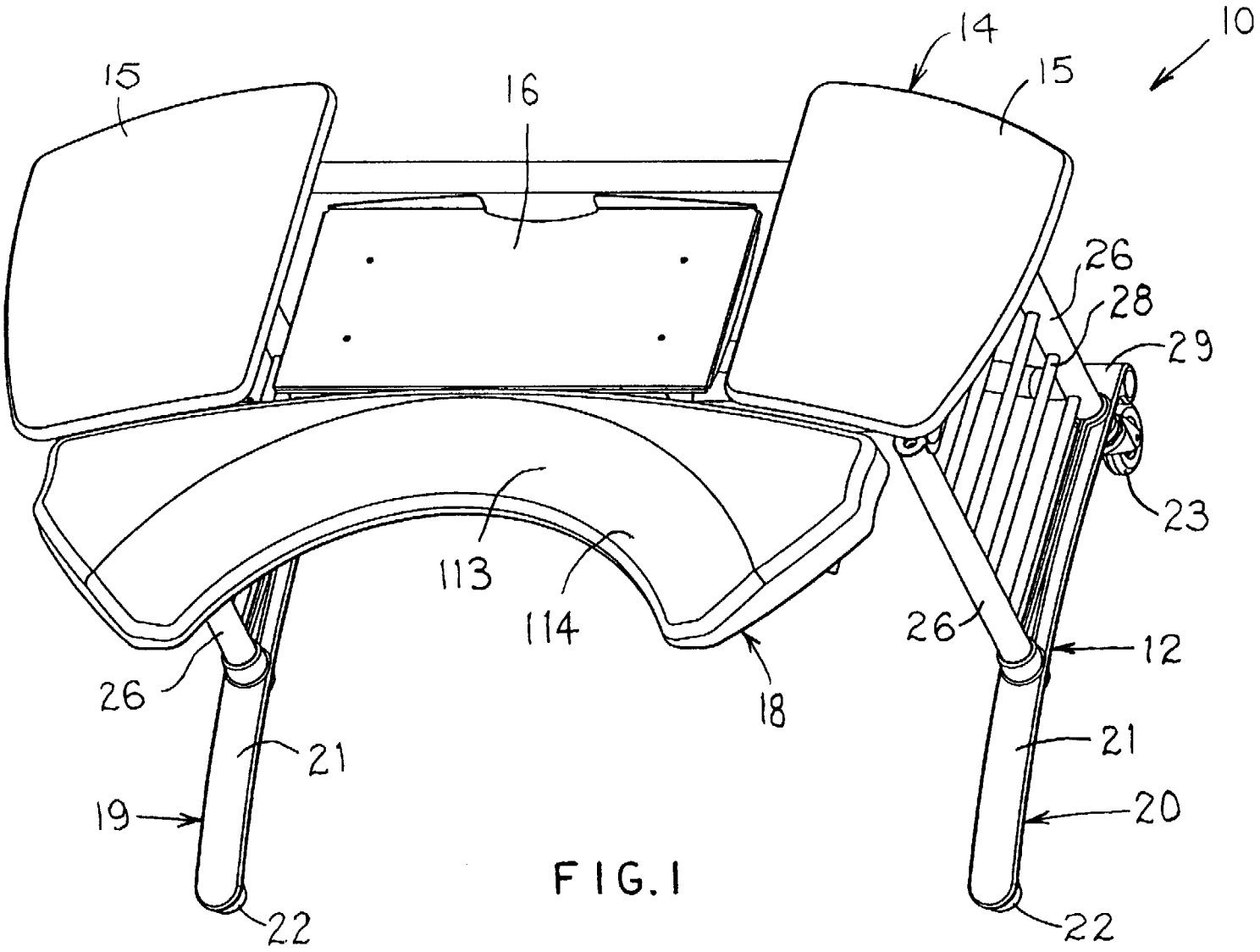
FIG. 1 is a front perspective view of a keyboard support stand of the invention.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 2:
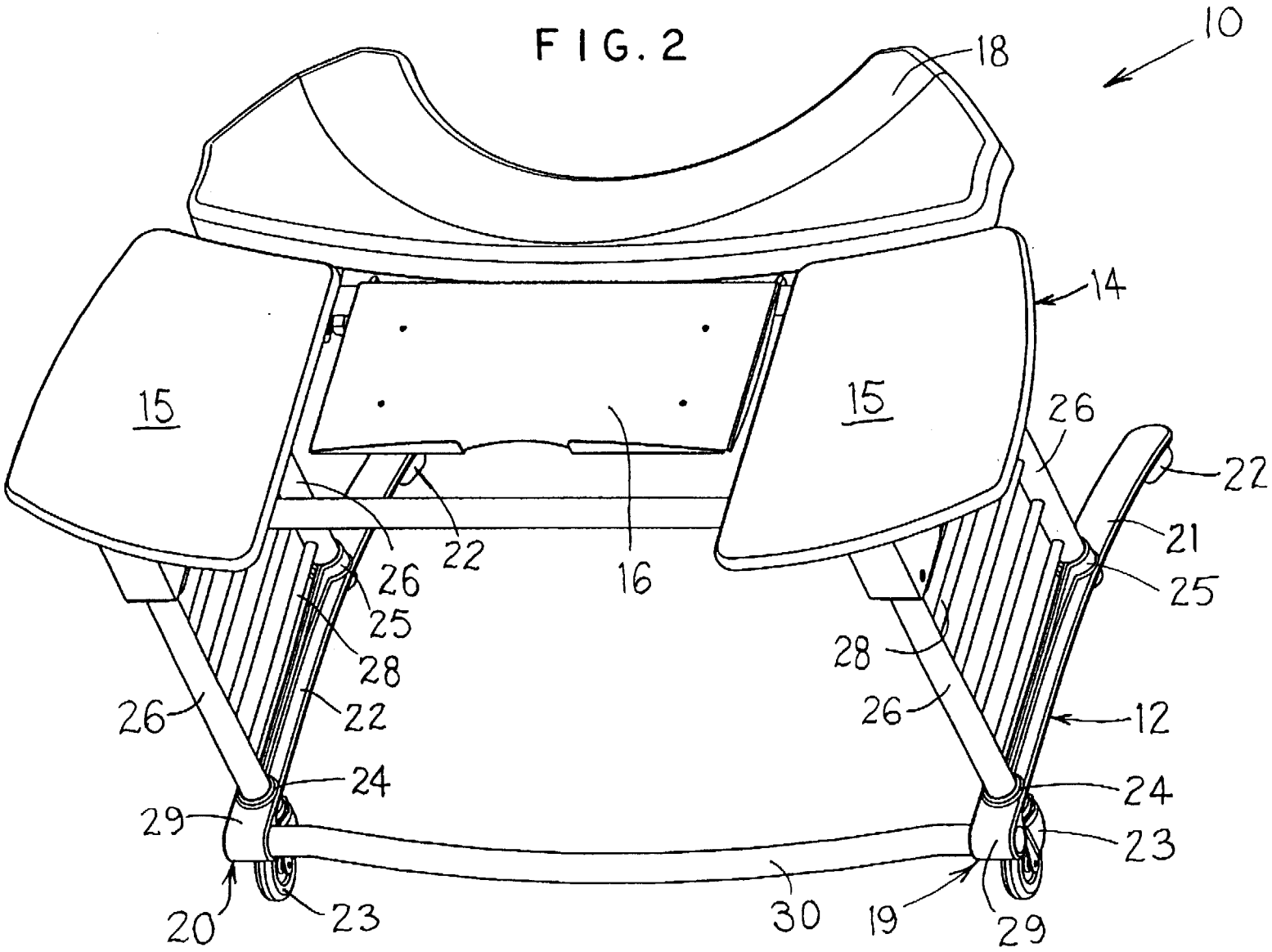
FIG. 2 is a rear perspective view of the keyboard support of FIG. 1.

Referring to FIGS. 1 and 2, this invention relates to a keyboard support stand 10 that includes a support frame assembly 12 and a height-adjustable top worksurface assembly 14 supported thereon. The top assembly 14 includes spaced-apart side worksurfaces 15, an angularly adjustable keyboard tray or worksurface 16 which is adapted to support a conventional computer keyboard (not illustrated), and an angularly adjustable arm rest 18 which is adapted to support the arms of a user (not illustrated).

Figure 7:
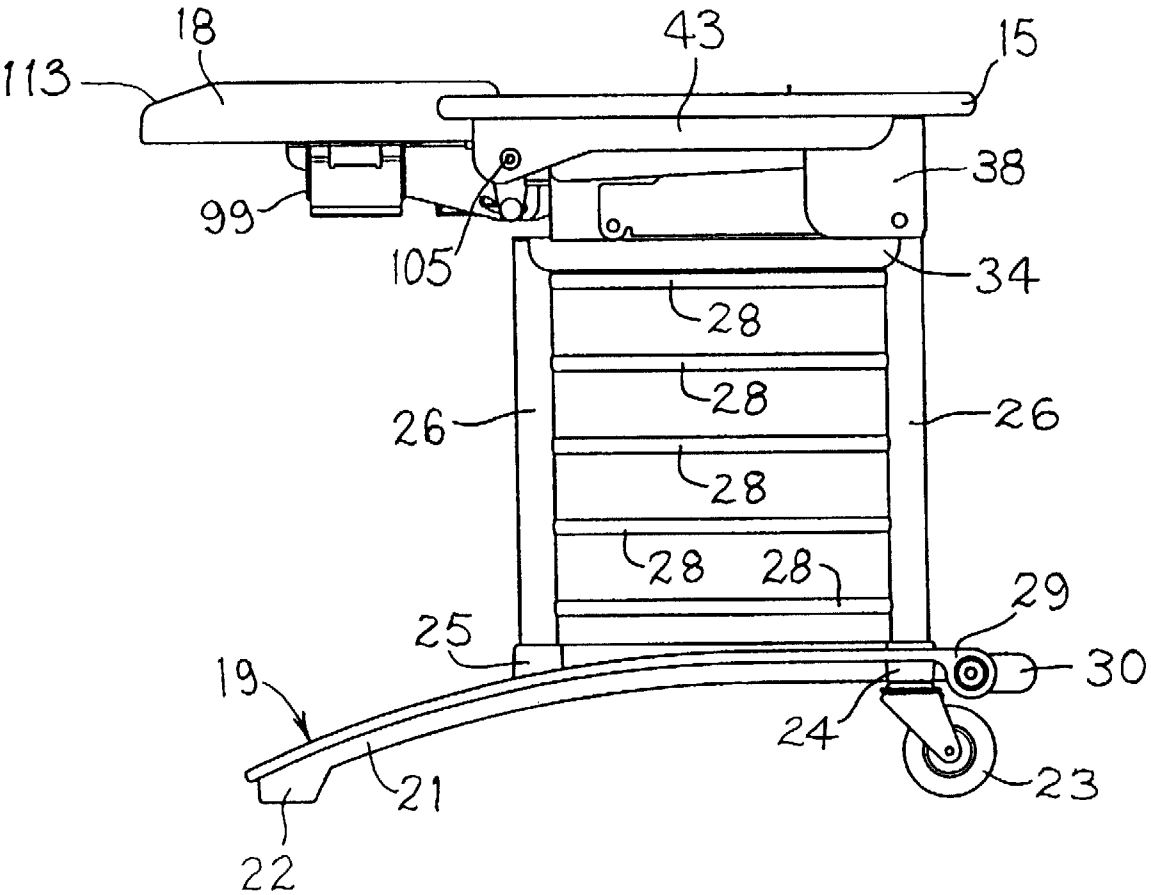
FIG. 7 is a right side elevational view.
Figure 10:
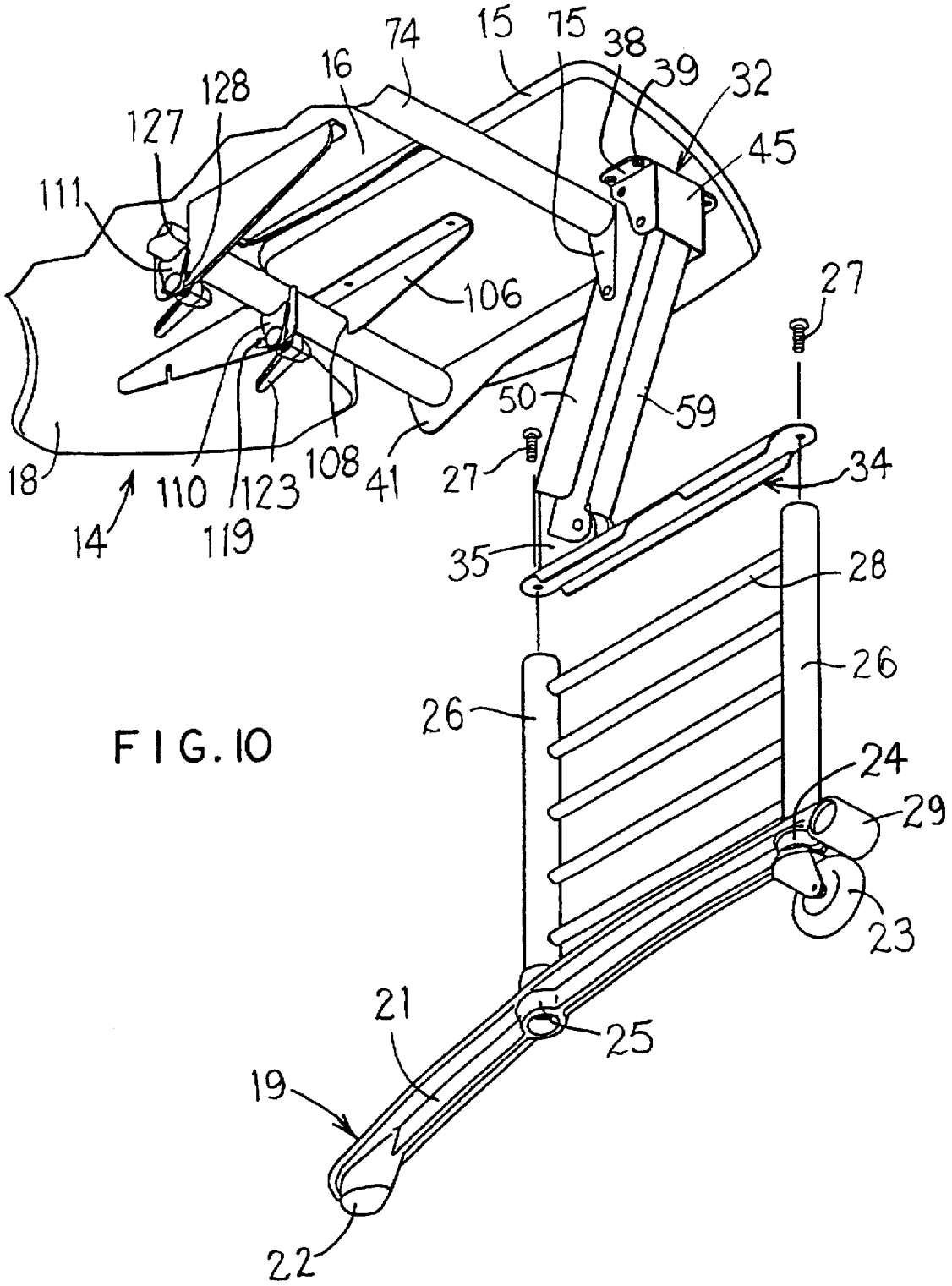
FIG. 10 is a partial exploded perspective-view of the keyboard support illustrating a left leg structure separated from the top assembly.

More particularly, the support frame assembly 12 includes respective left and right leg assemblies. 19 and 20 which extend upwardly from a base surface (not illustrated) such as a floor so as to vertically support the top assembly 14. As illustrated in FIGS. 2, 7 and 10, each leg assembly 19 and 20 includes a horizontally elongate base member 21 having a support foot or glide 22 at a forward end which is adapted to rest upon the floor. To facilitate repositioning of the keyboard stand 10, a caster 23 of conventional construction is mounted on the base member 21 adjacent the rearward end thereof. The support foot 22 and caster 23 support the keyboard support stand 10 on the floor or other base surface while permitting easy repositioning of the keyboard support 10 by raising the support foot 22 off of the floor and then rolling the keyboard support 10 by way of the casters 23 to a new location.

The base member 21 is provided with rear and front vertically projecting tubular hubs 24 and 25 fixed thereto, the front hub 25 being generally midway between the ends of the base member 21 in that it is spaced rearwardly a substantial distance from the front end.

Each hub 24 and 25 includes a tubular support leg or upright 26 which seats within the respective hub and extends substantially vertically therefrom to a predetermined height. Each upright 26 includes an insert fixed within the upper end thereof, which insert is formed with a threaded bore that opens vertically and is adapted to threadedly engage a threaded fastener 27 (FIG. 10). Each pair of parallel uprights 26 for the respective left and right leg assemblies 19 and 20 are rigidly joined together at their upper ends by a horizontally elongate mounting arm or plate 34 (FIG. 10) extending therebetween and fixedly joined thereto by the fasteners 27. Each leg assembly 19 and 20 also includes a plurality of horizontal cross members 28 which are vertically spaced apart in parallel relation and are rigidly connected at their opposite ends to the respective uprights 26 to define ladder-like sides of the keyboard support stand 10.

To rigidly connect the leg assemblies 19 and 20 one with the other, each base member 21 is formed with a tubular seat 29 at the rearward end adjacent the caster 23. The tubular seat 29 includes a hollow bore which opens laterally horizontally. The leg assemblies 19 and 20 are disposed in a laterally spaced relation and fixedly secured one with the other by a laterally extending cross tube 30 having its opposite ends fixedly secured within the respective tubular seats 29 of the left and right leg assemblies.

The frame assembly 12 thereby defines a U-shape having a forward opening space for receiving the legs of a user. To further accommodate the legs of a user, the cross tube 30 is provided with a curvature so as to bow rearwardly and further increase the size of the space which is formed below the top assembly 14.

Figure 5:
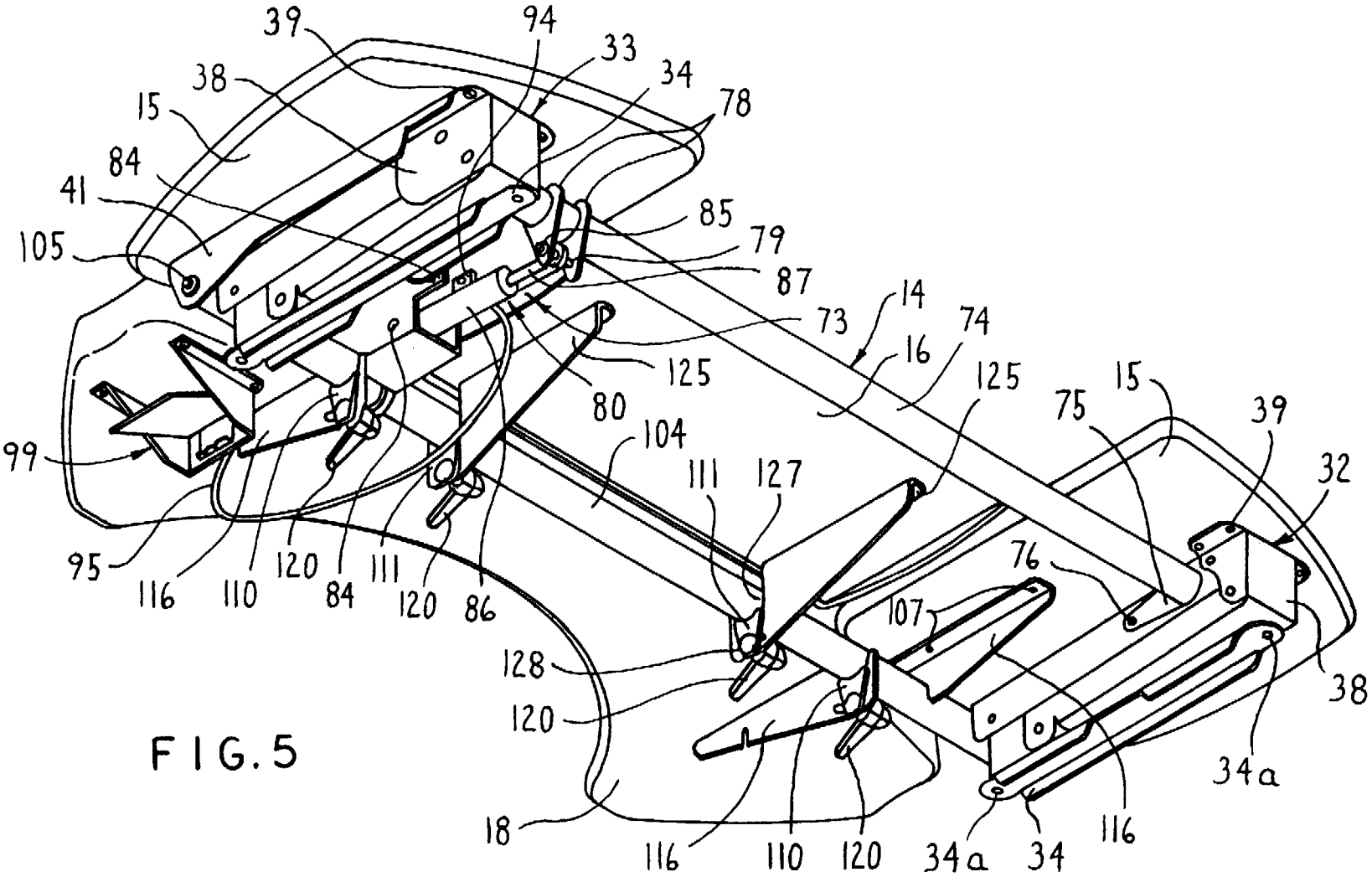
FIG. 5 is a perspective view as viewed from a rearward bottom corner of the keyboard stand and illustrating a top worksurface assembly thereof.
Figure 6:
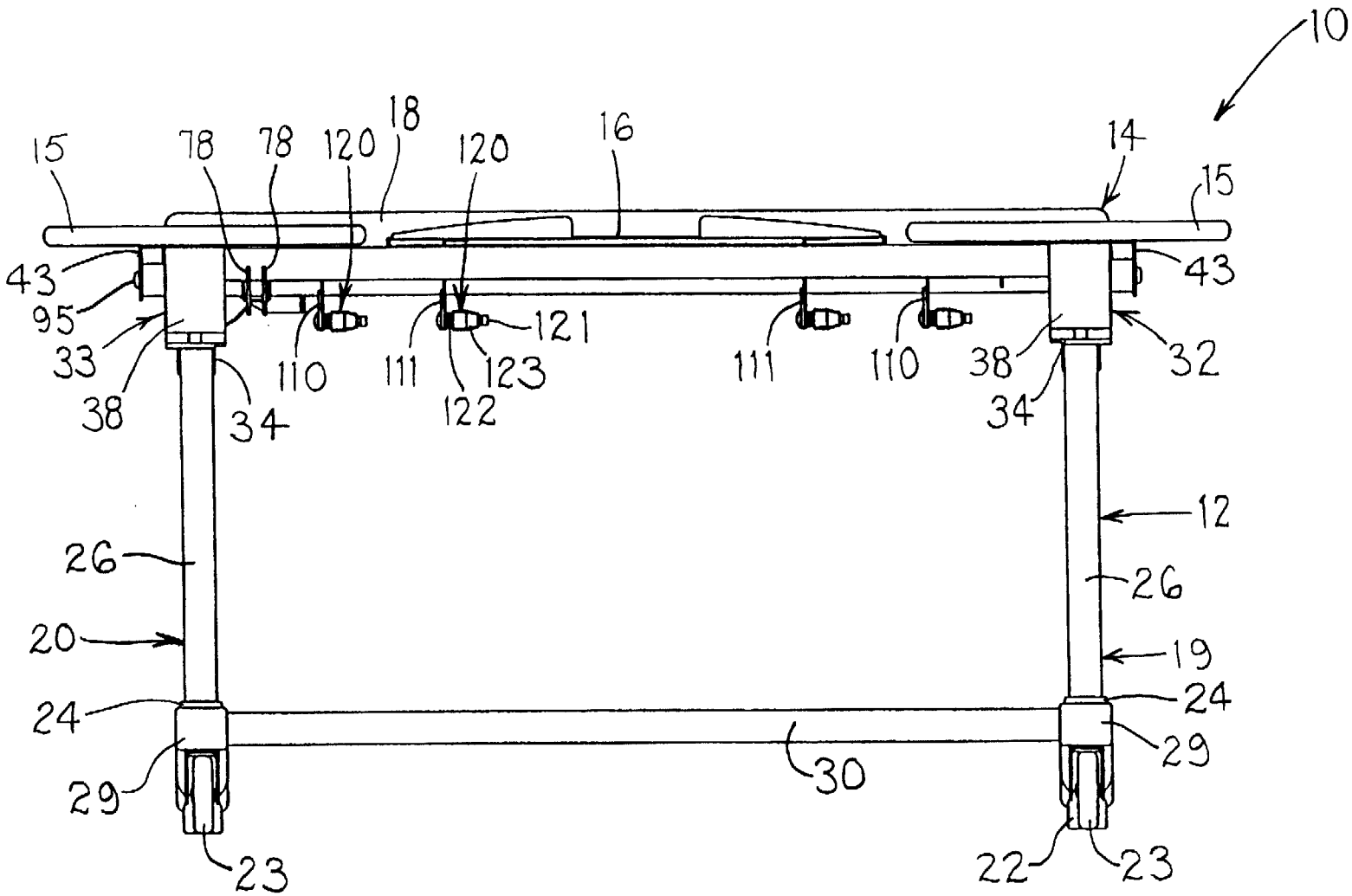
FIG. 6 is a rear elevational view.

To connect the top assembly 14 to the frame assembly 12 while permitting adjustment of the height of the top assembly 14, the opposite ends of the top assembly 14 are connected to the left and right leg assemblies 19 and 20 by respective left and right arm assemblies 32 and 33 as illustrated in FIGS. 5 and 6 which generally define four-bar linkages. The arm assemblies 32 and 33 are substantially identical except they are formed as mirror images of one another. Thus, the following description of the left arm assembly 32 is equally applicable to the right arm assembly 33.

Figure 10A:
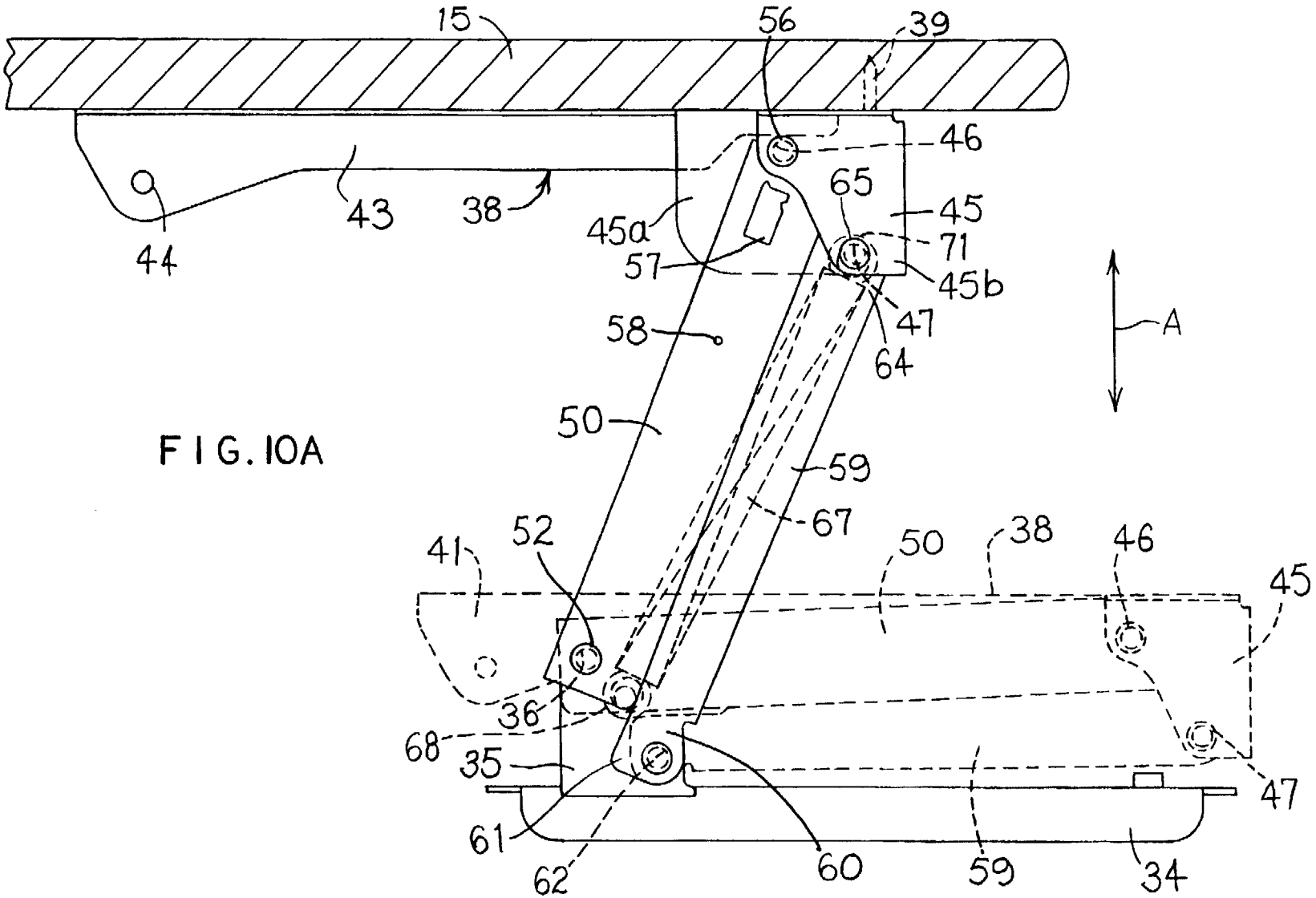
FIG. 10A is a partial side cross-sectional view illustrating the arm assembly of FIG. 10.

More particularly, the arm assembly 32 includes a lower pivot bracket 35 which is fixed to the respective mounting plate 34 adjacent the front end thereof. The lower pivot bracket 35 has two parallel but vertically spaced apart apertures 36 and 37 (FIG. 10A) which define pivot locations for the four-bar linkage as discussed hereinafter.

Figure 12:
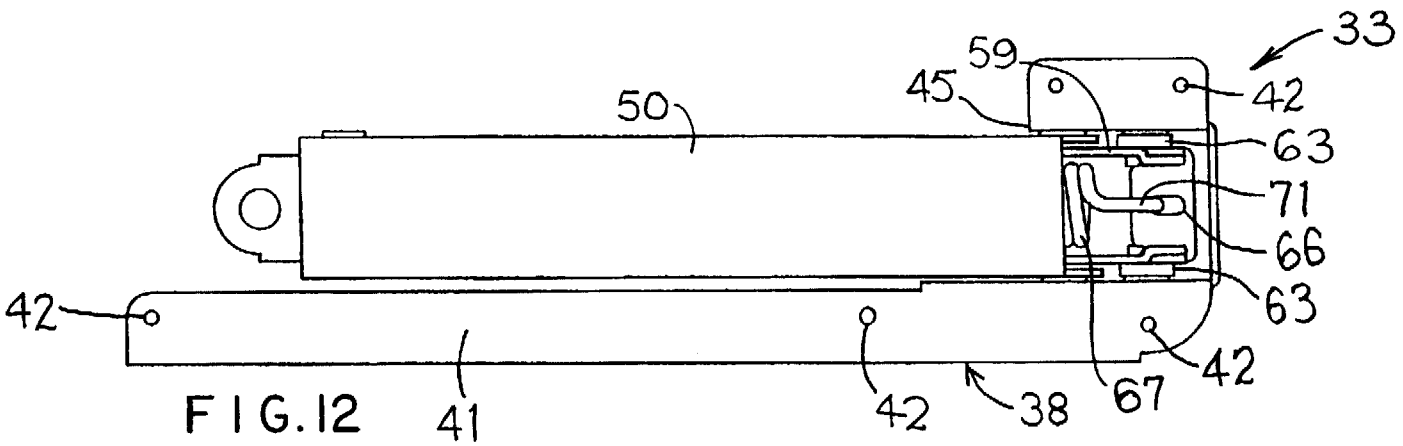
FIG. 12 is a top plan view of the arm assembly.

To connect the arm assembly 32 to the bottom of the respective side worksurface 15, there is provided an upper mounting bracket 38 which is fixedly secured to the bottom of the respective side worksurface 15 by fasteners 39. The mounting bracket 38 is substantially L-shaped in cross section and includes a horizontally elongate leg 41 formed with apertures 42 (FIG. 12) that receive the fasteners 39 therethrough for mounting to the bottom of the side worksurfaces 15. The leg 44 joins to a downwardly depending leg or plate 43 formed with an aperture 44 therethrough at a forward end thereof.

The mounting bracket 38 has a pivot bracket 45 which is fixed to a rearward end of the leg 41 and opens both downwardly and forwardly. The pivot bracket 45 includes respective upper and lower apertures 46 and 47 formed in the opposing side walls thereof to define two additional pivot locations for the four-bar linkage.

The four-bar linkage of assembly 32 includes an upper pivot arm 50 (FIGS. 10, 10A and 12) which is pivotally pinned at its opposite ends to the brackets 35 and 45. More particularly, the upper pivot arm 50 has a U-shaped cross section that is open along the lower side thereof. The upper pivot arm 50 is connected to the lower pivot bracket 35 by a horizontal pivot pin 52 extending through the apertures 36, and is connected to the upper pivot bracket 45 by a horizontal pivot pin 56 extending through the apertures 46. Pivot pins 52 and 56 define parallel and horizontal pivot axes which extend transversely or sidewardly of the support stand. The pivot arm 50 also includes a notch 57 and an aperture 58 disposed intermediate the opposite ends thereof.

The four-bar linkage also includes an inner or lower pivot arm 59 which extends between the bracket 35 and 45 with its opposite ends respectively pivotally connected thereto by horizontal and parallel pivot pins 62 and 65 received in apertures 37 and 47 respectively. The inner pivot arm 59 also partially nests within the open side of the outer pivot arm 50. The four-bar linkage as described in effect defines a parallelogram, whereby the side worksurface 15 is vertically movable relative to the lower mounting plate 34 between a lowered position illustrated in phantom outline in FIG. 10 and a raised position illustrated in solid outline, while at the same time the worksurface 15 remains in a generally horizontal orientation.

Figure 11:
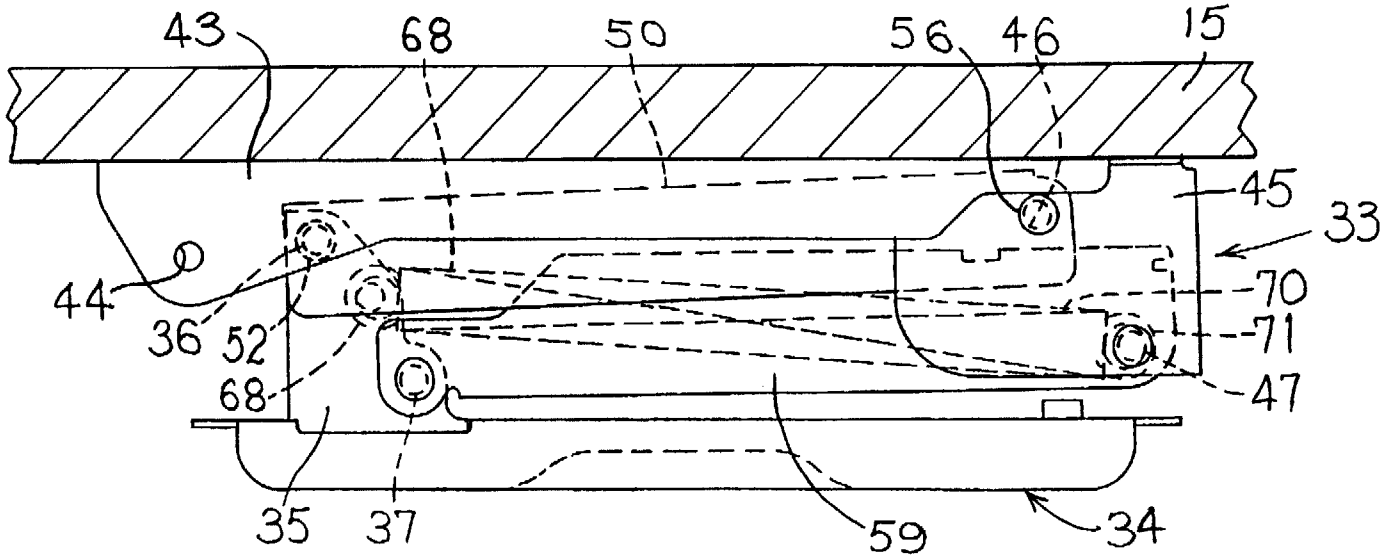
FIG. 11 is a side cross-sectional view illustrating the arm assembly of FIG. 10A in a lowered position.

To bias the arm assembly 32 to the raised position, a coil spring 67 has a forward end 68 connected to the lower bracket 35 by way of a horizontal pin 68 (FIGS. 10A, 11 and 12) extending between the opposing side walls of the lower bracket 35. The rearward end 70 of the spring 67 includes a hooked part 71 which connects to a slot 66 (FIG. 12) formed in the inner pivot arm 59 adjacent the rearward end thereof. The coil spring 67 normally is in the retracted condition when the arm assembly 32 is in the raised position of FIG. 10A. However, during lowering of the arm assembly 32 to the position illustrated in FIG. 11 a tension force is applied to the coil spring 67 such that the spring 67 tends to bias the pivot arms 50 and 59 toward the raised position.

To insure that the two side worksurfaces 15 as well as the arm assemblies 32 and 33 vertically move in unison, the two side worksurfaces 15 are rigidly joined together by respective front and rear horizontally extending cross rods 104 and 74 (FIG. 5) which are generally parallel and extend in the transverse or sideward direction of the support stand. The connection of these rods to the worksurfaces 15 is explained below.

Figure 4:
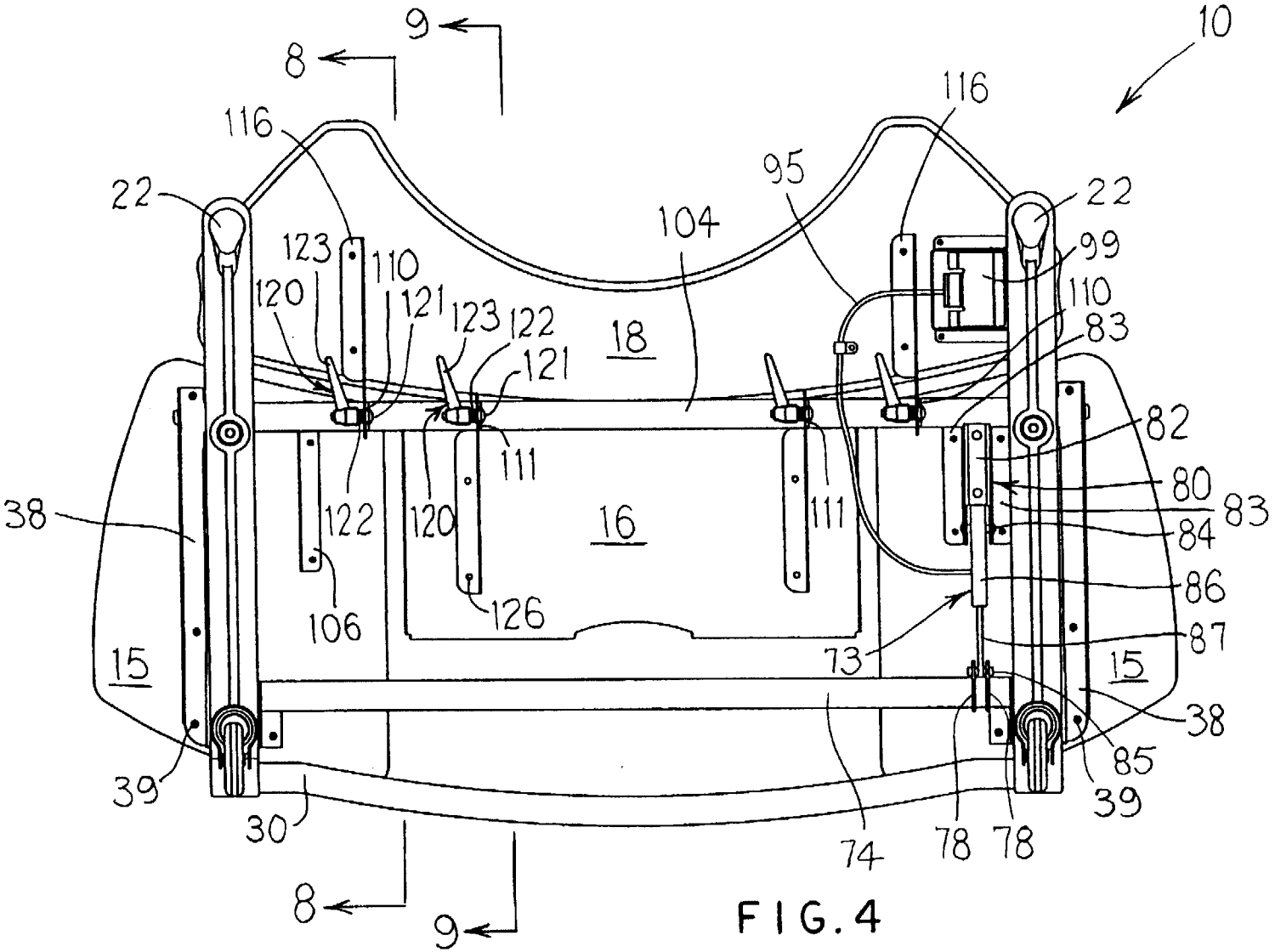
FIG. 4 is a bottom view.

Referencing now FIGS. 4 and 5, to effect locking of the arm assemblies 32 and 33 in the raised or lowered positions or at any intermediate position therebetween, a brake assembly 73 is operatively interconnected to the left and right arm assemblies 32 and 33. The brake assembly 73 includes the elongate tubular cross rod 74 which extends substantially horizontal proximate a rearward edge region of the keyboard support 10. The cross rod 74 includes a connection arm 75 at each end which projects radially. To connect the cross rod 74 to each of the arm assemblies 32 and 33, the connecting arm 75 includes an aperture as well as a projecting tab (not illustrated) which correspond to the aperture 58 and notch 57 of the outer pivot arm 50 such that the projecting tab on the arm 75 seats within the notch 57 (FIG. 10A) and a threaded fastener 76 is threadingly engaged to the aperture 57. By providing fastener 76 and projecting tab (not illustrated) which respectively seat within the aperture 57 and notch 58 of the outer pivot arm 50, the cross rod 74 is fixedly and non-rotatably connected to the respective outer pivot arms 50. Thus, during movement between the raised and lowered positions, the cross rod 74 moves in unison with the outer pivot arms 50.

The cross rod 74 also includes a pair of lock plates 78 fixed thereto and disposed proximate the right arm assembly 33 (FIG. 5). The lock plates 78 project radially outward of the cross rod 74 and are spaced longitudinally to define a space therebetween. Each lock plate 78 includes an aperture 79 proximate the distal end thereof. The lock plates 78 do not project in the same radial direction as the end arms 75, but instead are angularly offset one with respect to the other by approximately 60 degrees so that when the cross rod 74 is connected to the arm assemblies 32 and 33 and the arm assemblies 32 and 33 are in the lowered position (FIG. 5), the lock plates 78 project downwardly and somewhat forwardly relative to the end arms 75.

To restrain vertical movement of the left and right arm assemblies 32 and 33, the lock plates 78 are operatively connected to a brake mechanism 80 (FIGS. 5 and 13) which is part of brake assembly 73. The brake mechanism 80 includes a lock bracket 82 (FIG. 4) which defines a channel therebetween and includes horizontal side flanges 83 having apertures formed therethrough for fastening of the lock bracket 82 to a bottom surface of the right side worksurface 15. The sidewalls of the lock bracket 82 also include apertures formed therethrough for the connection of the brake mechanism 80 to the lock bracket 82 by way of a fastener 84.

To fix the position of the lock plates 78 relative to the mounting bracket 82 and thereby prevent vertical adjustment of the left and right arm assemblies 32 and 33, the brake mechanism 80 includes a brake housing 86 and an extension rod 87 which projects rearwardly therefrom. The extension rod 87 is elongate and slidably received through the brake housing 86 so that a forward end 88 (FIG. 13) projects forwardly out of the brake housing 86 and a rearward end 89 projects rearwardly from the brake housing 86. The rearward end 89 terminates in an enlarged connector 90 formed with a bore 91 which receives a fastener 85 therethrough when aligned in registry with the apertures 79 of the lock plates 78 so that the rearward end 89 of the extension rod 87 is fixedly and pivotally connected to the lock plates 78. The brake housing 86 includes a transverse bore 92 which receives the fastener 84 therethrough so as to pivotally and fixedly connect the brake housing 86 to the mounting bracket 82.

Figure 13:
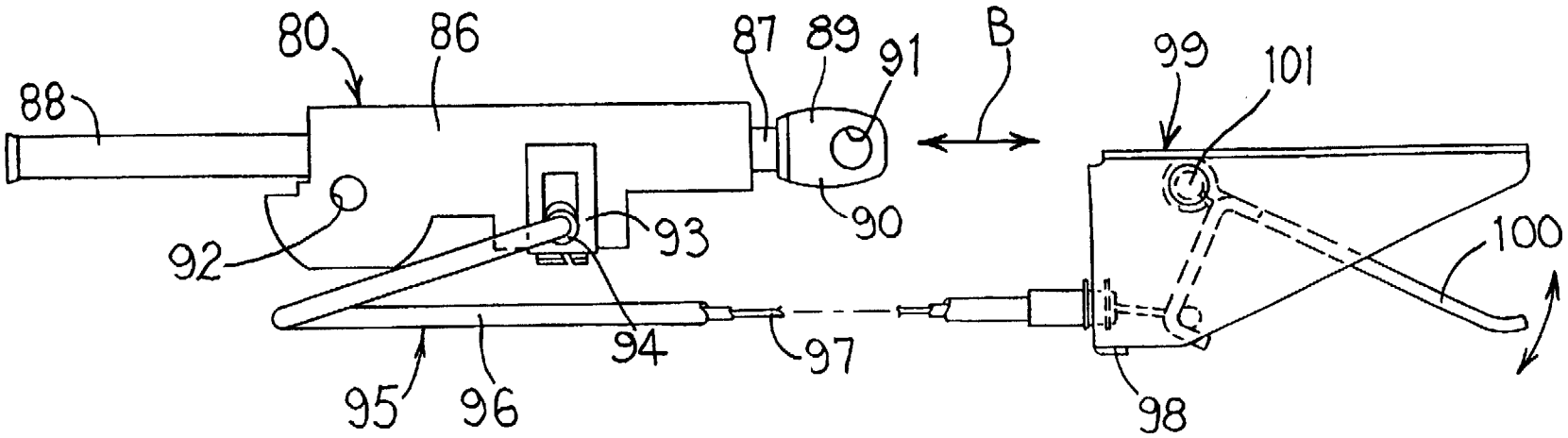
FIG. 13 is a fragmentary side elevational view diagrammatically illustrating a brake mechanism and actuator therefor for maintaining the top assembly at a selected height.

The brake housing 86 is formed to define a hollow horizontally elongate interior chamber which opens from the forward and rearward ends and slidably receives the extension rod 87 therethrough so that the extension rod 87 is horizontally movable generally in the direction of arrow B in FIG. 13. To effect locking of the arm assemblies 32 and 33 in a selected position at or between the lowered and raised positions, a coil or wrap spring is axially restrained within the hollow interior of the brake housing 86 and is formed with a diameter which tightly grips or wraps the extension rod 87 and prevents axial movement of the extension rod 87 relative to the brake housing 86. To release the extension rod 87, the brake housing 86 includes a connecting flange 93 which is disposed adjacent an opening into the hollow interior thereof. A radially projecting lever 94 is connected to the wrap spring so as to be circumferentially movable to effect partial unwrapping of the spring to release the rod 87. The connecting flange 93 and lever 94 are respectively connected to the sheath 96 and slidable interior cable 97 of a conventional coaxial cable construction.

The sheath 96 is connected at an opposite (i.e. front) end to a housing 98 of an actuator 99, which housing 98 is mounted under the rightward end of the arm rest 18 (FIG. 4). This front end of the interior slide cable 97 is connected to a downwardly depending leg of an actuator lever 100 which is pivotally connected to the actuator housing 98 by a pivot pin 101. Upward pivoting of the lever 100 unwraps or releases the interior wrap spring and thus releases the extension rod 87 to permit axial sliding thereof in the direction of arrow B. The brake mechanism 80 as described herein is of a known spring wrap type, one example of which is sold by P.L. Porter Company, Woodland Hills, Calif., and thus a more detailed description of such brake mechanism 80 is not believed necessary. A skilled artisan will also readily appreciate that other braking means may be used to effect releasing and locking of the arm assemblies 32 and 33.

To support the keyboard tray 16 and the arm rest 18, the cross rod 104 extends laterally between the side worksurfaces 15 from the left arm assembly 32 to the right arm assembly 33. The cross rod 104 is connected to the respective left and right arm assemblies 32 and 33 by fasteners 105 which extend through the apertures 44 (FIG. 6 and 7) provided at the front ends of the mounting brackets 38. The cross rod 104 also has a leftward mounting bracket 106 (FIGS. 4 and 10) welded thereto. The horizontal leg of the mounting bracket 106 is provided with apertures for receiving fasteners 107 that fixedly connect the mounting bracket 106 to the bottom surface of the leftward side worksurface 15.

The downwardly depending vertical flange of mounting bracket 106 is provided with an arcuate notch 108 at the forward end thereof which receives the cross rod 104 therein, whereby mounting bracket 106 is fixedly welded to the rod 104. The lock bracket 82 is similarly provided with an arcuate notched portion at the forward end thereof which receives the rod 104 therein and is fixedly connected together by welding or the like. To connect the arm rest 18 and tray 16 to the front cross rod 104, the rod 104 includes a first pair of flanges 110 (FIGS. 4 and 5) which project radially therefrom in a downward direction, and includes a further pair of similar flanges 111, as further described below.

Figure 3:
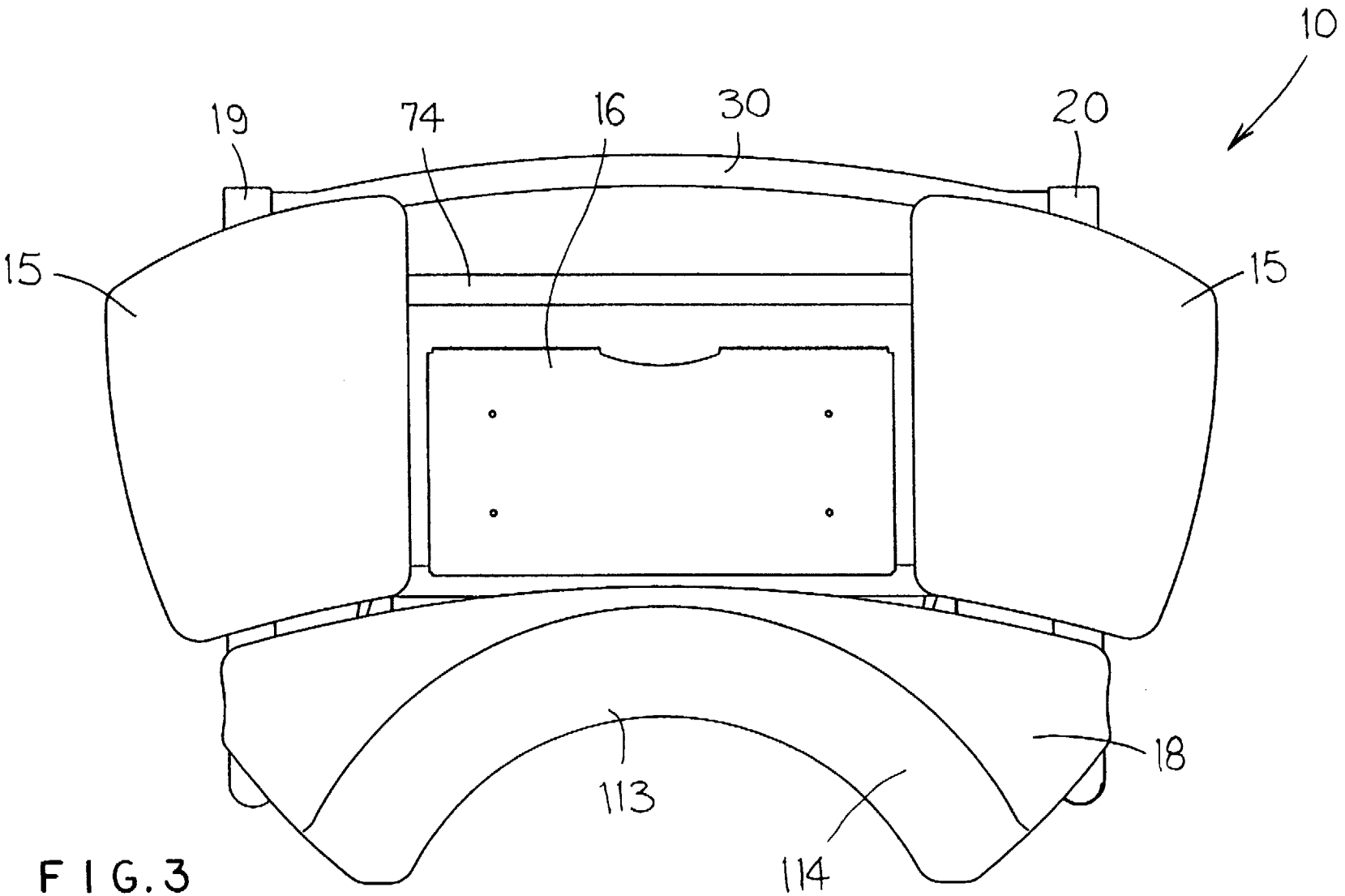
FIG. 3 is a top plan view.

As shown in FIGS. 1 and 3, the arm rest 18 extends laterally between the left and right sides or edges of the keyboard support 10, and includes an arcuate front portion 113 which is defined by a front edge that curves inwardly to provide a region for accommodating a user. The front portion 113 tapers upwardly in the rearward direction to define an inclined surface 114 upon which the arms of a user rest during use.

Figure 8:
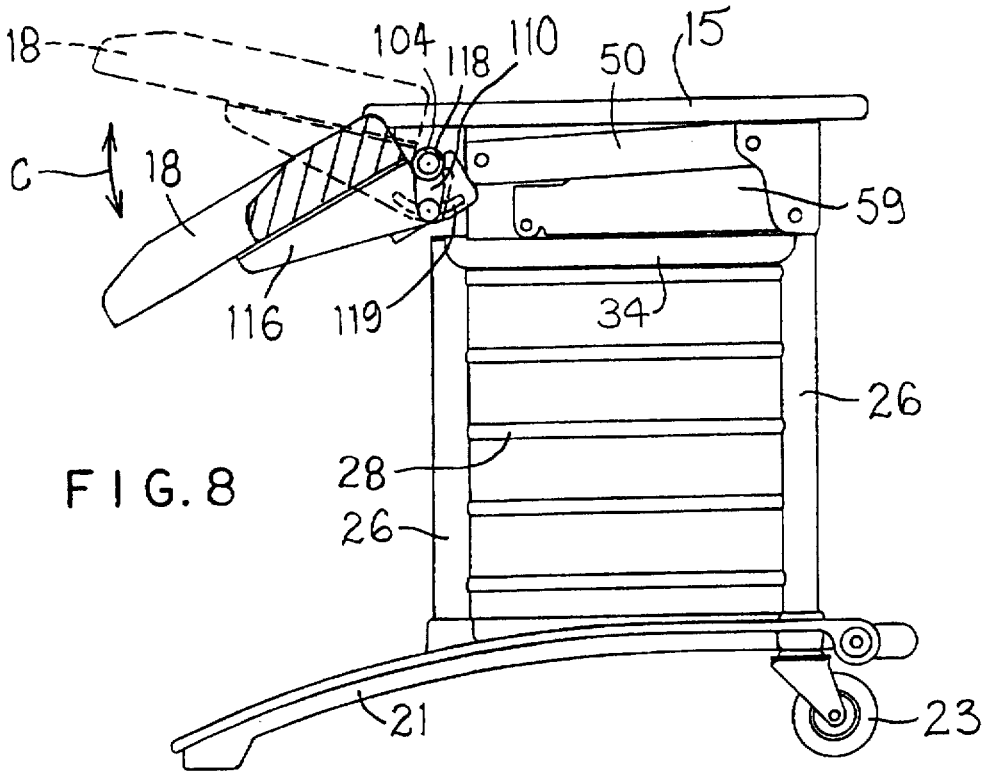
FIG. 8 is a sectional view as viewed in the direction of arrows 8—8 of FIG. 4 and illustrating the arm rest being angularly adjusted.

To connect the arm rest 18 to the front cross rod 104, a pair of arm rest mounting brackets 116 are mounted to the bottom surface of the arm rest 18 as illustrated in FIGS. 4, 5 and 8. The brackets 116 have an upwardly opening semi-circular notch formed at the rear end thereof which projects rearwardly and is seated upon the support tube 104. The notches 118 are freely pivotable about the outer periphery of the cross rod 104. Each arm rest mounting bracket 116 includes an arcuate slot 119 generated about the axis of rod 104. The mounting bracket 116 is connected to one of the arm rest flanges 110 by a spring-loaded ratchet lever assembly 120 (FIGS. 4–6) which comprises a threaded shaft or bolt 121 extending through the aperture of the flange 110 and also through the slot 119 so as to support the mounting bracket 116 on the flange 110. The ratchet lever assembly 120 also includes a locking nut 122 which is threaded onto the bolt 121 so as to fixedly clamp the flanges 110 and 116 between the locking nut 122 and the head of the bolt 121. To effect clamping and unclamping, the locking nut 122 includes gear teeth on the exterior circumferential surface thereof which engage with corresponding teeth formed in a hollow interior of a lever 123 which slides axially along the bolt 121. A spring (not illustrated) is provided within the hollow interior of the lever 123 to normally bias the lever 123 away from the locking nut 122. Upon axial sliding of the lever 123 into engagement with the teeth of the locking nut 122, rotation of the lever 123 then causes rotation of the locking nut 122 to thereby clamp brackets 110 and 116 together so as to lock the arm rest 18 in a selected angular orientation relative to cross rod 104. The lever 123 is free to rotate about the bolt 121 when not engaged with the locking nut 122. Ratchet-like clamping lever assembly 120 is conventional.

The slot 119 is formed to permit the threaded bolt 121 to travel along the length thereof which results in angular pivoting of the arm rest 18 about the longitudinal axis of the cross rod 104. When the arm rest 18 is disposed in a generally horizontal position as illustrated in FIGS. 5 and 7, the forward end of the slot 119 is preferably disposed about 32.5 degrees from a vertical center line extending through the arm rest flange 110, and the rearward end of the slot 119 is preferably disposed about 12.5 degrees from this vertical center line such that the threaded bolt 121 travels along the slot 119 through an angular path of about 45 degrees.

As illustrated in more detail in FIG. 8, the arm rest 18 is movable along the path indicated by arrow C from a lowermost tilted position oriented approximately 30 degrees below a horizontal plane when the bolt 121 is disposed at the forward end of the slot 119, and is movable to an uppermost tilted position oriented about 12 to 15 degrees above the horizontal plane when the bolt 121 is disposed at the rearward end of the slot 119. The relative length and position of the slot 119 can be varied if desired to adjust the angular path through which the arm rest 18 travels. Once the arm rest 18 is positioned at a selected angular orientation, the ratchet lever assemblies 120 are tightened so as to lock the arm rest 18 in position.

Figure 9:
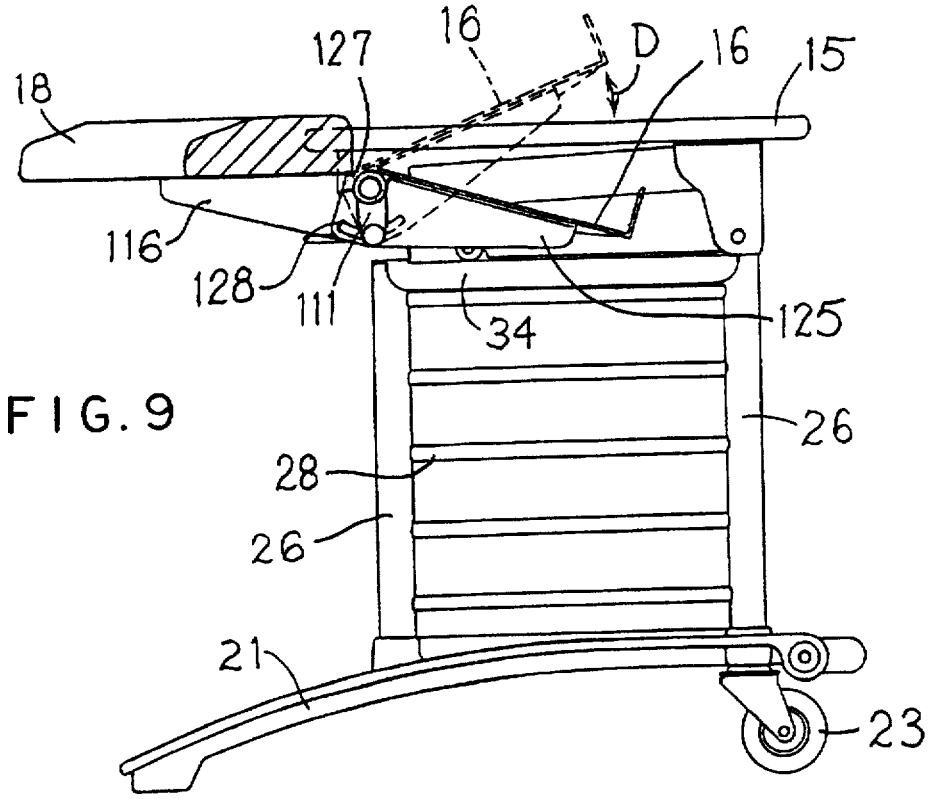
FIG. 9 is a sectional view as viewed in the direction of arrows 9—9 of FIG. 4 and illustrating the keyboard tray being angularly adjusted.

The keyboard tray 16 is similarly attached to the cross rod 104. More particularly, the keyboard tray 16 also includes a pair of mounting brackets 125 (FIGS. 5 and 9), the vertical flange of which is formed with an upwardly opening notch 127 at the forward end thereof which projects forwardly beyond the front edge of the side worksurfaces 15. The notch 127 seats onto the cross rod 104 so that the tray mounting brackets 125 pivot about the longitudinal axis of the rod 104.

Each tray mounting bracket 125 includes a slot 128 (FIG. 9) which receives the bolt 121 of a further ratchet lever assembly 120. Similar to slot 119 described above, the slot 128 is also angularly elongate so as to define an angular path through which the bolt 121 can slide during angular repositioning of the tray 116 (FIG. 9), whereby keyboard tray is tiltably movable between an upward tilted position (illustrated in phantom outline in FIG. 9) of about 18 degrees above a horizontal plane and a downward tilted position of about approximately 18 degrees below the horizontal plane. The keyboard tray 16 is thus movable along a path generally indicated by arrow D in FIG. 9 through an angular range of approximately 35 degrees. The keyboard tray 16 can be fixedly positioned at any selected angular position at or between the maximum raised and lowered tilted positions to optimize the relative angle of a keyboard (not illustrated) on the keyboard tray 16 relative to the arm rest 18.

During operation, the keyboard stand 10 can be selectively positioned at any desired location in either a temporary or permanent office space. Once positioned, the height of the worksurfaces 15, the keyboard tray 16 and the arm rest 18 can be adjusted to an optimal elevation for each individual user by pivoting the lever of the actuator 99 to thereby release the brake mechanism 80 and allow the left and right arm assemblies 32 and 33 to be moved between the raised and lowered positions. The springs 67 normally bias the top assembly 14 upwardly so as to assist in the raising of the top assembly 14 while also permitting easy lowering of same to any desired location by application of downward pressure on the worksurfaces by the user. Once the height is adjusted, the actuator 99 is released so as to re-engage the brake mechanism 80 and, more particularly, restrain movement of the extension rod 87 to prevent further vertical movement of the top assembly 14.

Additionally, to optimize the comfort of a user who is using a keyboard (not illustrated) disposed on the keyboard tray 16, the two ratchet lever assemblies 120 connected between the keyboard flanges 111 and the tray mounting brackets 125 can be released for adjustment of the angular position or orientation of the keyboard tray relative to a horizontal plane. The keyboard tray can be adjusted along an angular path of approximately 35 degrees. Once the desired position is set, the ratchet lever assemblies 120 are retightened by rotation of the respective levers 123 to rotate the locking nuts 122 and thereby clamp the tray mounting brackets 125 and keyboard flanges 111 in a fixed relation.

Similarly, the angular orientation of the arm rest 18 can also be adjusted to optimize the comfort of a user. Similar to the adjustment of the keyboard tray 16, the ratchet lever assemblies 120 connected between the arm rest flanges 110 and the arm rest mounting brackets 116 are released so that the respective bolts 121 are slidable along the slot 119. Once the arm rest is tilted into the desired position, the ratchet lever assemblies 120 are retightened so as to affix the arm rest 18 at any desired location along the angular path indicated by arrow C in FIG. 8.

The arm rest 18 will typically be at least partially provided with a foam-like elastomeric material to provide an upper surface having at least limited resiliency or cushioning for contact with the user's arms.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A keyboard support stand for supporting at least a computer keyboard, comprising:

first and second leg assemblies which are disposed in a laterally spaced relation and are height-adjustable, said leg assemblies including a fixed lower portion, an upper portion, and adjustment means for selectively adjusting the vertical height of said upper portion relative to said lower portion;

an elongate support member extending laterally between said first and second leg assemblies and connected to said upper portions so as to move in combination therewith during adjustment of said height;

an arm rest disposed on a front side of said support member and having arm rest connector parts which are pivotally joined to said support member to permit vertical angular displacement of said arm rest about said support member; and a keyboard tray disposed on a rear side of said support member in a space between said first and second leg assemblies, said keyboard tray including keyboard connector parts pivotally joined to said support member to permit vertical angular movement of said keyboard tray about said support member.

2. A keyboard support stand according to claim 1, wherein said arm rest is angularly pivotable about said support member so as to move in a vertical plane through an angular path of approximately 45 degrees, said angular path extending both above and below a horizontal plane.

3. A keyboard support stand according to claim 1, wherein said keyboard tray is angularly pivotable about said support member so as to move in a vertical plane through an angular path of approximately 35 degrees, said angular path extending both above and below a horizontal plane.

4. A keyboard support stand according to claim 1, wherein each of said upper portions of said first and second leg assemblies include respective firs and second side work surfaces connected thereto, said side work surfaces being disposed on opposite lateral sides of said keyboard tray and being horizontally enlarged to provide an upward facing support surface.

5. A keyboard support stand according to claim 1, wherein said adjustment means is operatively connected to releasable brake means for selectively braking said adjustment means to selectively restrain vertical displacement of said upper portion relative to said lower portion.

6. A keyboard support stand according to claim 1, wherein said adjustment means include first and second pivot arms having first ends connected to a front end region of one of said upper and lower portions of said leg assembly and having second ends connected to-a rear end region of the other of said upper and lower portions of said leg assemblies, said first and second support arms generally defining a parallelogram so as to permit relative vertical movement of said upper portion relative to said lower portion.

7. A keyboard support stand according to claim 6, wherein said adjustment means includes biasing means connected between said upper and lower leg portions so as to bias said upper portion upwardly relative to said lower portion.

8. A keyboard support stand according to claim 1, wherein said arm rest connector parts include an arcuate slot which is aligned with a respective aperture of said support member and slidably receives a pin of a locking device which extends therethrough and into said respective aperture, said slot being slidable along said pin so as to permit relative angular movement of said arm rest relative to said support member, said locking device being actuatable to fix said arm rest connector part relative to said support member and being releasable to permit said relative angular movement of said arm rest.

9. A keyboard support stand according to claim 1, wherein said keyboard connector parts include an arcuate slot which is aligned with a respective aperture of said support member and slidably receives a pin of a locking device which extends therethrough and into said respective aperture, said slot being slidable along said pin so as to permit relative angular movement of said keyboard relative to said support member, said locking device being actuatable to fix said keyboard connector part relative to said support member and releasable to permit said relative angular movement of said keyboard.

10. A keyboard support stand according to claim 1, wherein each of said upper portions of said leg assemblies include respective first and second side worksurfaces connected thereto, said side worksurfaces being disposed on opposite lateral sides of said keyboard tray and being horizontally enlarged to provide upward facing support surfaces, said arm rest being angularly pivotable about said support member so as to move in a vertical plane through an angular path of approximately 45 degrees, and said keyboard tray being angularly pivotable about said support member so as to move in a vertical plane through an angular path of approximately 35 degrees, said angular paths extending both above and below a horizontal plane.

11. A keyboard support stand according to claim 10, wherein said adjustment means include first and second pivot arms having first ends connected to a front end region of one of said upper and lower portions of said leg assembly and having second ends connected to a rear end region of the other of said upper and lower portions of said leg assemblies, said first and second support arms generally defining a parallelogram so as to permit relative vertical movement of said upper portion relative to said lower portion.

12. A keyboard support stand for supporting at least a computer keyboard comprising:

a support frame including a fixed lower frame portion and an upper frame portion, and adjustment means connected to said upper and lower frame portions for selectively adjusting a height of said upper frame portion relative to said lower frame portion;

first and second worksurfaces connected to said upper frame portion to move in combination therewith during said height adjustment, said first and second work surfaces being disposed in laterally spaced relation so as to define an intermediate open area therebetween;

an arm rest defining an upward facing surface and being pivotally joined to support means of said upper frame portion so that said arm rest is angularly pivotable in a vertical plane; and a keyboard tray defining an upward facing surface and being disposed in said intermediate open area, said keyboard tray being pivotally joined to said support means of said upper frame portion so that said keyboard tray is angularly pivotable in a vertical plane.

13. A keyboard support stand according to claim 12, wherein said support means defines a horizontal axis about which both said arm rest and said keyboard tray are angularly pivotable.

14. A keyboard support stand according to claim 13, wherein said support means comprises an elongate support member extending laterally between said first and second worksurfaces, said keyboard tray and said arm rest being disposed respectively on opposite front and rear sides of said support member.

15. A keyboard support stand according to claim 12, wherein said adjustment means include first and second pivot arms having first ends connected to a front end region of one of said upper and lower frame portions of said support frame and having second ends connected to a rear end region of the other of said upper and lower frame portions of said support frame, said first and second support arms generally defining a parallelogram so as to permit relative vertical movement of said upper frame portion relative to said lower frame portion.

16. A keyboard support stand for supporting at least a computer keyboard, comprising:

a support frame having first and second leg assemblies disposed in a laterally spaced relation and elongate support means which extends laterally and is connected to said first and second leg assemblies, said leg assemblies each including a base structure having a pair of elongate legs extending upwardly, a plurality of horizontal cross members connected between said legs which are vertically spaced apart one from the other, a caster at a rear portion of the base structure for rolling engagement with a floor, and a glide at a front portion of said base structure so as to be supported on the floor;

first and second worksurfaces connected respectively to upper portions of said first and second leg assemblies, said first and second worksurfaces being horizontally enlarged and disposed in laterally spaced relation so as to define an intermediate open area therebetween;

an elongate arm rest which extends laterally along a front of said support frame, said arm rest being joined to said support means such that said arm rest defines an upward facing surface extending forwardly away from said support means;

a horizontally enlarged keyboard tray joined to said support means so as to be disposed rearwardly of said arm rest, said keyboard tray defining an upward facing surface disposed in said intermediate space; and adjustment means for selectively adjusting a height of said first and second worksurfaces as well as said arm rest and said keyboard tray relative to said leg assemblies, said adjustment means having a lower portion connected to the upper ends of said first and second leg assemblies and an upper portion connected to said support means add said first and second worksurfaces which move in combination therewith, said upper portion being vertically movable relative to said lower portion to adjust the height of said arm rest, keyboard tray and first and second worksurfaces.

17. A keyboard support stand according to claim 16, wherein said support means is an elongate support member, said arm rest and said keyboard tray including connector means for pivotally joining said arm rest and said keyboard tray to said support member so as to be angularly pivotable in a vertical plane.

18. A keyboard support stand according to claim 16, wherein said adjustment means include first and second pivot arms having first ends connected to a front end region of one of said upper and lower portions and having second ends connected to a rear end region of the other of said upper and lower portions, said first and second support arms generally defining a parallelogram so as to permit said relative vertical movement.

19. A keyboard support stand according to claim 18, wherein said support means is an elongate support defining a horizontal axis, said arm rest and said keyboard tray including connector means for pivotally joining said arm rest and said keyboard tray to said support so as to be angularly pivotable in a vertical plane about said horizontal axis, said arm rest extending forwardly away from said horizontal axis and said keyboard tray extending rearwardly away from said horizontal axis.

20. A support stand for supporting office equipment thereon, comprising:

a support frame which includes a base adapted to be supported on a floor;

an elongate support member which extends laterally and is connected to an upper portion of said support frame, a first open area being defined forwardly of said support member and a second open area being defined rearwardly of said support member;

an elongate arm rest which is disposed on a front side of said support member and extends laterally, said arm rest being horizontally enlarged to define an upward facing surface and including first connector means for pivotally joining a rearward portion of said arm rest to said support member to permit vertical pivoting about said support member in said first open area, said front connector means including first locking means for releasably locking said front support plate in a selected angular orientation relative to said support member; and a rear worksurface which is disposed on a rear side of said support member and is adapted to support office equipment thereon, said rear worksurface including second connector means for pivotally joining a forward portion of said rear worksurface to said support member to permit vertical pivoting of said rear worksurface about said support member in the region of said second open area, said second connector means including second locking means for releasably locking said rear worksurface in a selected angular orientation relative to said support member without the angular orientation of said arm rest.

21. A support stand according to claim 20, wherein said support frame includes height-adjustment means for adjusting the height of said support member relative to said base, said arm rest and said rear worksurface being movable vertically in combination with said support member.

22. A support stand according to claim 20, wherein each of said first and second connector means include fixed connector plates projecting outwardly from said support member and movable connector plates which are fixed to said front and rear support plates so as to move therewith, each one of said fixed connector parts being joined to one of the movable connector parts by a connector pin for said pivoting of said front and rear support plates relative to said support member.

23. A support stand according to claim 22, wherein said support member defines a horizontal pivot axis about which both of said front and rear support plates pivot, said movable connector parts including a semi-circular part which is movable circumferentially about the outer surface of said support member, said connector pin being spaced from said horizontal pivot axis while being fixed to one of said first and second connector parts and being slidable along an arcuate slot formed in the other of said first and second connector parts to permit angular pivoting of said arm rest and said rear worksurface.

24. A support stand according to claim 20, wherein the opposite ends of said support member are fixedly supported on said support frame, said support member including an intermediate section which extends between said fixed opposite ends thereof, said first and second connecting means pivotally connecting said arm rest and said rear worksurface respectively to said intermediate section on the opposite forward and rearward sides thereof.

* * * * *

UNITED STATES PATENT AND TRADEMARK OFFICE

CERTIFICATE OF CORRECTION

PATENT NO. : 5,704,299

DATED : January 6, 1998

INVENTOR(S) : Roque Matias Corpuz, Jr. et al

It is certified that error appears in the above-indentified patent and that said Letters Patent is hereby corrected as shown below:

Column 9, line 31; change "firs" to ---first---.

line 45; change "to-a" to ---to a---.

Column 11, line 40; change "add" to ---and---.

Signed and Sealed this

Sixteenth Day of June, 1998

*Attest:*

*Attesting Officer*

BRUCE LEHMAN

*Commissioner of Patents and Trademarks*